US011725416B2

(12) United States Patent
Lin et al.

(10) Patent No.: US 11,725,416 B2
(45) Date of Patent: Aug. 15, 2023

(54) DOOR HANDLE ADAPTER FOR SPRUNG HUB

(71) Applicant: Spectrum Brands, Inc., Middleton, WI (US)

(72) Inventors: James Lin, Laguna Niguel, CA (US); Eric Xin, Xaimen (CN); Doo Fai Yip, Rowland Heights, CA (US)

( * ) Notice: Subject to any disclaimer, the term of this patent is extended or adjusted under 35 U.S.C. 154(b) by 890 days.

(21) Appl. No.: 15/856,694

(22) Filed: Dec. 28, 2017

(65) Prior Publication Data

US 2018/0187450 A1 Jul. 5, 2018

Related U.S. Application Data

(60) Provisional application No. 62/439,974, filed on Dec. 29, 2016.

(51) Int. Cl.
*E05B 1/00* (2006.01)
*E05B 3/04* (2006.01)
(Continued)

(52) U.S. Cl.
CPC ..... *E05B 1/0053* (2013.01); *E05B 3/04* (2013.01); *E05B 3/065* (2013.01); *E05B 15/0013* (2013.01)

(58) Field of Classification Search
CPC .... E05B 2001/0076; E05B 3/08; E05B 15/04; E05B 2015/0406; E05B 2015/0448;
(Continued)

(56) References Cited

U.S. PATENT DOCUMENTS 5,205,596 A * 4/1993 Ralph ..... E05B 3/065 292/224
5,335,948 A * 8/1994 Norton, II ..... E05B 3/065 292/169.23
(Continued)

FOREIGN PATENT DOCUMENTS

DE 9016080 U1 2/1991
DE 29517151 U1 * 12/1995 ..... E05B 3/08
(Continued)

OTHER PUBLICATIONS

Machine Translation of WO0134926A1, 2020, pp. 1-2 (Year: 2020).*
(Continued)

*Primary Examiner* — Christine M Mills
*Assistant Examiner* — Yahya Sidky
(74) *Attorney, Agent, or Firm* — Merchant & Gould P.C.

(57) ABSTRACT

An adapter for either a handle set or a lever set door lever is equipped with a pair of springs to provide a pre-load on the spindle. The pre-load prevents sagging of the lever due to the large mass of the lever. A sleeve in the adapter is formed out of a compressible material that accepts the spindle in a press-fit configuration. This allows for greater manufacturing tolerances while still providing a solid and secure engagement between the spindle and the adapter. As a result, any free play in the lever is eliminated and the lever is maintained in a horizontal, home position when the lever is not in use. Following use through rotation of the lever, the springs promptly return the lever back to the home position while the sleeve prevents any slop or free-play in the lever's motion.

13 Claims, 7 Drawing Sheets

(51) Int. Cl.
*E05B 15/00* (2006.01)
*E05B 3/06* (2006.01)

(58) Field of Classification Search
CPC ..... E05B 2015/0496; E05B 3/065; E05B 15/0013; E05B 1/0053; E05B 3/04; E05C 1/085; E05C 1/12; E05C 1/16; E05C 1/163; Y10T 292/0969; Y10T 292/097; Y10T 292/1014; Y10T 292/1016; Y10T 292/59; Y10T 292/93; Y10T 292/96; Y10S 292/52; Y10S 292/61
See application file for complete search history.

(56) References Cited

U.S. PATENT DOCUMENTS 5,658,026 A * 8/1997 Nigro, Jr. ..... E05B 13/002 292/336.3
6,491,327 B1 * 12/2002 Fan ..... E05B 3/065 292/165
6,921,116 B2 * 7/2005 Humes ..... E05C 1/163 292/169
2006/0043742 A1 * 3/2006 Huang ..... E05B 63/0056 292/336.3
2010/0264672 A1 * 10/2010 Ellis ..... E05B 3/065 292/87
2014/0165669 A1 * 6/2014 Tien ..... E05B 53/00 70/91
2016/0083976 A1 * 3/2016 Rickenbaugh ..... E05C 9/12 292/336.3
2020/0115937 A1 * 4/2020 Xin ..... F16H 19/04

FOREIGN PATENT DOCUMENTS

EP 0761912 A1 3/1997
GB 916182 A * 1/1963 ..... E05B 15/04
GB 2359849 A 9/2001
TW M367955 U 11/2009
WO WO-0134926 A1 * 5/2001 ..... E05B 3/00

OTHER PUBLICATIONS

International Search Report and Written Opinion for International Application No. PCT/US2014/068783, dated May 11, 2018 (19 pgs).

* cited by examiner

DOOR HANDLE ADAPTER FOR SPRUNG HUB

CROSS-REFERENCE TO RELATED APPLICATIONS

The present application claims priority from U.S. Provisional Patent Application No. 62/439,974, filed Dec. 29, 2016, the disclosure of which is hereby incorporated by reference in its entirety.

TECHNICAL FIELD

This invention relates to the field of door locks. More particularly, this invention relates to hub adapters for door handles with removable spindles.

BACKGROUND OF THE INVENTION

Door knobs and levers are known to include springs that return the knob or lever back to a home position. This allows an operator to rotate the knob or lever, retract the latch, and open the door. Releasing the knob or lever allows the spring to use stored energy and return the knob or lever to its original position.

Different springs are also commonly used on door knobs and levers. As a lever extends away from the axis of rotation, a greater amount of resistive force is generated by the mass of the lever. Door knobs have a consistent mass around the entire rotational axis and do not extend as far from the rotational axis. For this reason, lighter springs are typically used on door knobs and heavier springs are used on levers.

One problem associated with sprung levers is that the lever can sag and not rest at a perfectly horizontal position. Efforts to resolve this issue have included simply using a stronger spring, but the increased resistance experienced by the operator is not optimal. Another problem associated with sprung levers is that the connection of the lever to the latch mechanism often includes some play, allowing the operator to loosely jiggle the handle. This issue has been addressed in the past by simply manufacturing pieces with tighter tolerances. Success has been limited as the tighter tolerances cause binding and require perfect alignment of the components, which rarely happens in installations.

What is therefore needed is an improved mechanism that prevents sagging of a lever handle. What is also needed is an improved mechanism that prevents a loose connection of the lever handle thereby minimizing any free-play.

SUMMARY AND OBJECT OF THE INVENTION

In one aspect of the invention, a door handle adapter comprises a spindle configured to engage a door handle and transfer an input rotational force from the door handle; a hub with a central aperture configured to receive the spindle and further transfer the rotational force from the spindle; a first engager extending from an outer circumference of the hub; a second engager opposite the first engager extending from the outer circumference of the hub; a slider with a first receiver configured to engage the first engager and a second receiver configured to engage the second engager such that as the rotational force is transmitted to the hub, thereby axially rotating the hub, at least one of the first and second engagers linearly displacing the slider; a first spring configured to engage the first receiver when the rotational force is in a first direction and also when the rotational force is in an opposing direction; a second spring to engage the second receiver when the rotational force is in the first direction and also when the rotational force is in the opposing direction; and a spacer formed of a material softer and more compressible than the hub and spindle inserted between the spindle and hub configured to retain a positive engagement between the spindle and hub.

In one example, the hub may be formed of one of zinc, brass, steel, and aluminum, and the spacer is a polymer.

The door handle adapter further comprises a liner providing a backstop for the first and second springs, wherein the first and second receiver provide opposing backstops for the respective first and second springs, thereby sandwiching at least a portion of each spring in between, respectively.

In another example, the first and second receivers are inserted in between a plurality of coils of the respective first and second springs, thereby engaging the springs when the slider is linearly displaced by the axial rotation of the spindle and hub.

The door handle adapter according to claim 1, wherein the slider is linearly displaced in the same direction when the hub is axially rotated the first direction as when the hub is axially rotated the opposing direction.

The door handle adapter according to claim 1, wherein the first and second springs maintain a torsional resistance against the input rotational force at all times.

BRIEF DESCRIPTION OF THE DRAWINGS

The present disclosure will be described hereafter with reference to the attached drawings which are given as non-limiting examples only, in which.

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION

Figure 1:
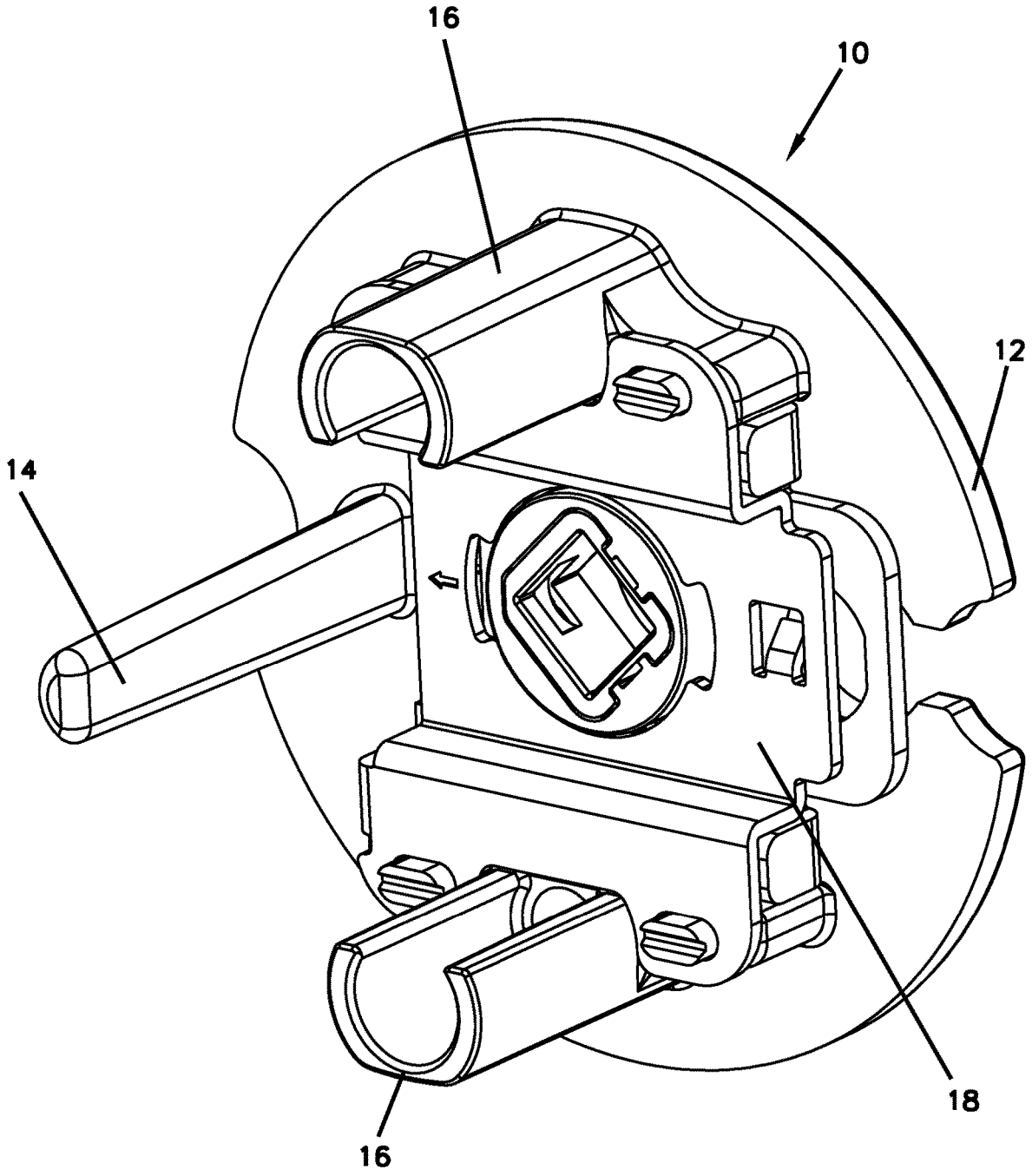
FIG. 1 shows a perspective view of an adapter according to an embodiment of the invention.
Figure 2:
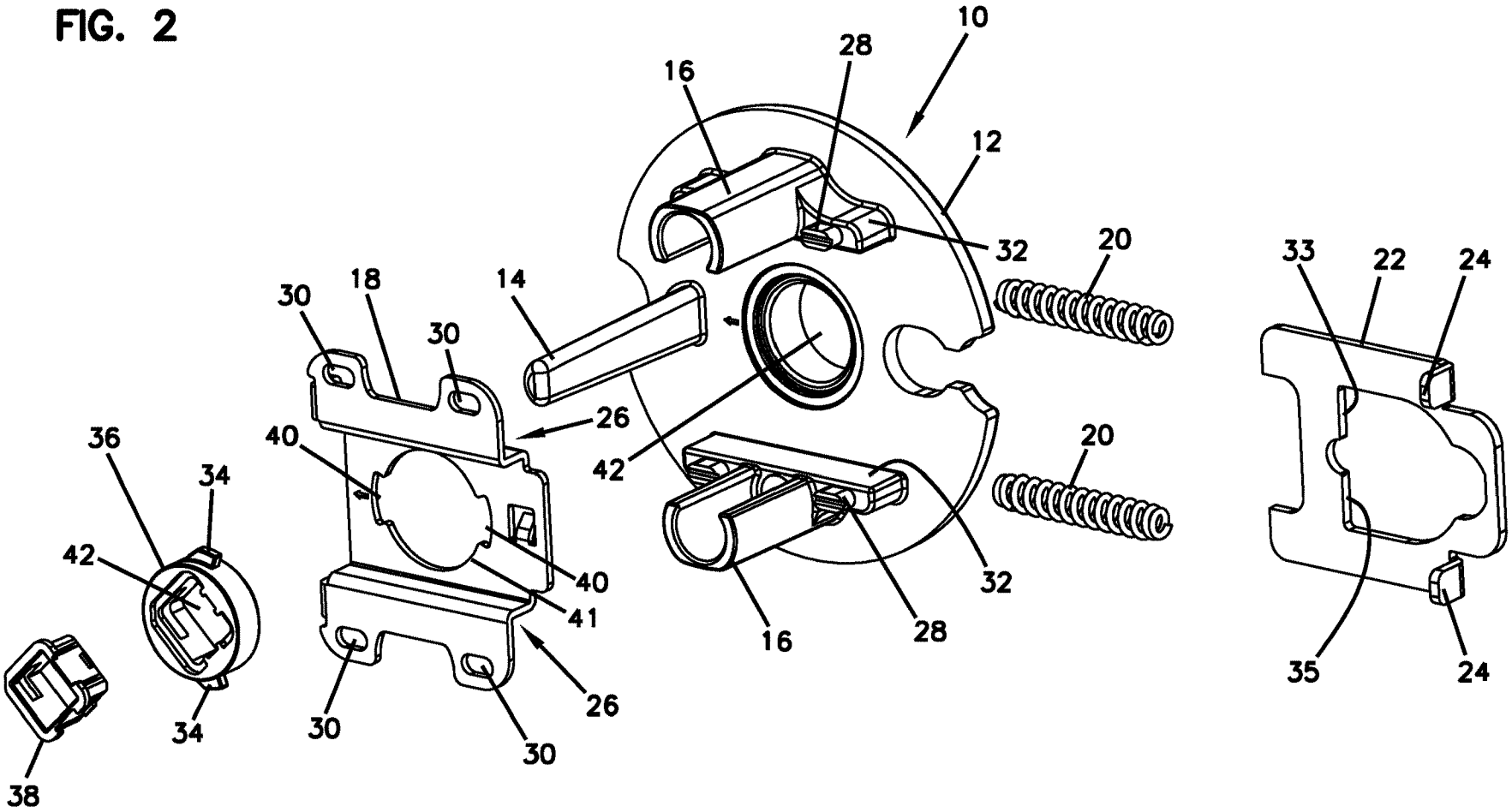
FIG. 2 shows an exploded perspective view of the adapter of FIG. 1.

Beginning with FIG. 1, an adapter 10 is shown. The adapter 10 is configured for installation on an interior side of an entry door. The adapter 10 is preferably formed of a single-piece with an arm 14 and pair of receivers 16 extending from a flange 12. The flange 12 is intended to rest on the interior surface of a door while the receivers 16 and arm 14 protrude into the hole formed into the door for the door handle (not pictured). The adapter 10 is also shown in FIG. 2 in exploded form with spring plate 18 components separated for view.

A slide 22 includes spring stops 24 that extend from the slide 22. The spring stops 24 contain a spring 20 on each side of a hole 42 formed in the adapter 10. The spring plate 18 contains the springs within spring chambers 26 thereby allowing the slide 22 to slide and compress springs 20 in the spring chambers 26 and rebound due to the spring force.

The adapter 10 includes a plurality of studs 28 extending from the flange 12. The studs 28 in particular extend from a base 32 that in turn extends from the flange 12, and act as mounting bosses to locate and retain the spring plate 18 in place. Each stud 28 is inserted into an aperture 30 on the spring plate 18 thereby preventing movement of the spring plate 18. The hole 42 formed in the center of the adapter 10 is lined up with an opening 41 in the spring plate 18. The opening 41 in the spring plate 18 includes slots 40 that receive engagers 34 on the outer diameter of a hub 36.

The hub 36 is configured to rotate within the hole 42 of the adapter and opening 41 of the spring plate 18. As the hub 36 rotates, the engagers 34 contact one of a first contact 33 and a second contact 35 on the slide 22. The engagers 34 interact with the first contact 33 or second contact 35 thereby causing the slide 22 to compress the springs 20 within the spring chamber 26. As a result, the hub 36 is compelled to rotate back to a "home" position by the stored energy in the springs 20, urging an inside lever 52 (see FIG. 3) in a horizontal position, whenever the hub 36 is rotated. A sleeve 38 may also be inserted into the central aperture 42 of the adapter 10. Preferably, the sleeve 38 is made out of a compressible material such as plastic.

The sleeve 38 acts as a buffer to take up any play that a spindle 48 (shown in FIG. 3) may have with the central aperture 42 in the adapter 10. The spindle 48 is therefore preferable pressed into the sleeve 38 such that a press-fit is required. Due to the nature of manufacturing processes used to form the spindle 48 and hub 36, it is very difficult to eliminate any play between the two components. Incorporating a sleeve 38 with a press-fit ensures a consistent, secure mating between the parts without any slop or play.

Figure 3:
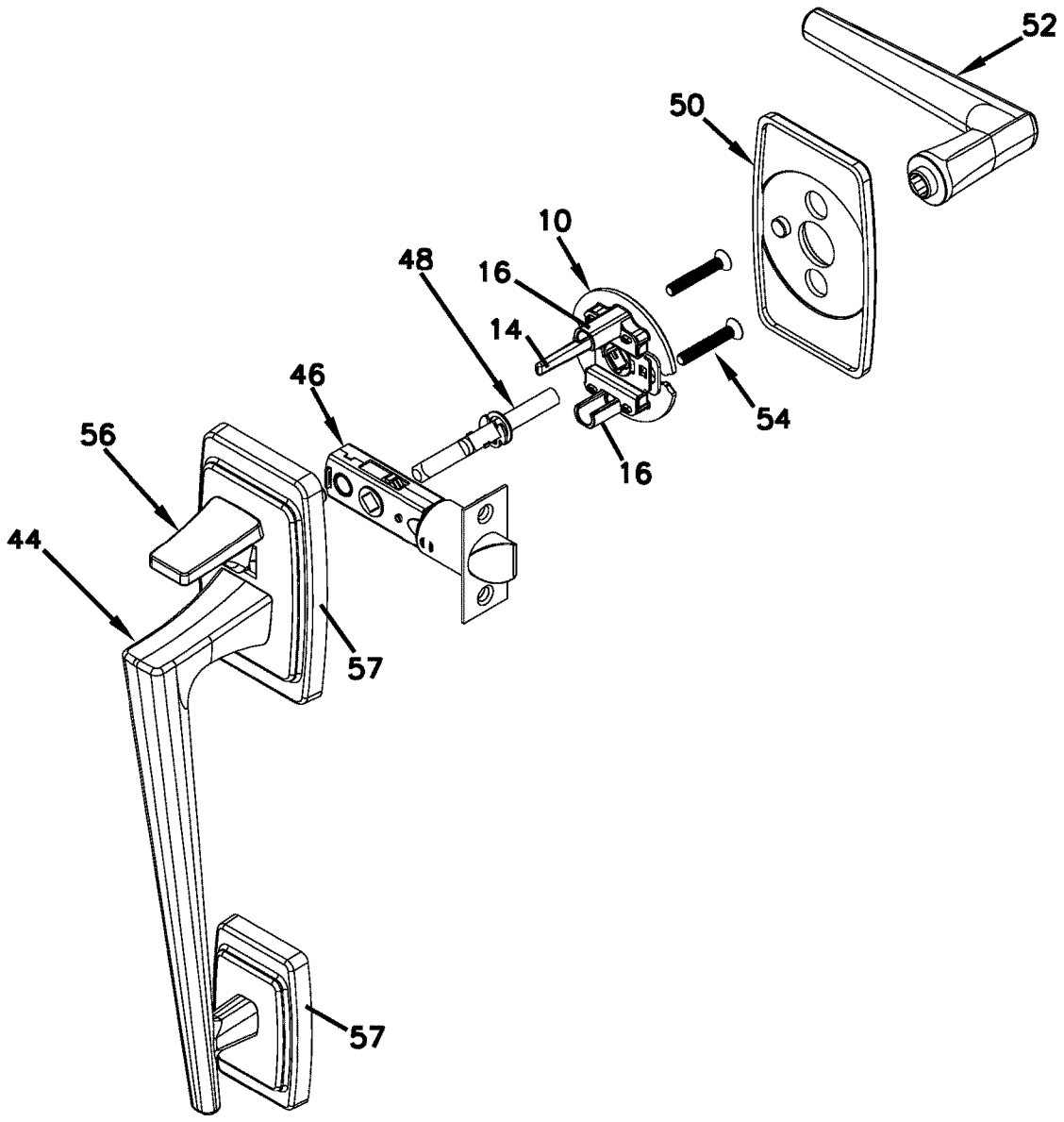
FIG. 3 shows a partially exploded perspective view of a handle set installation using the adapter of FIG. 1.
Figure 4:
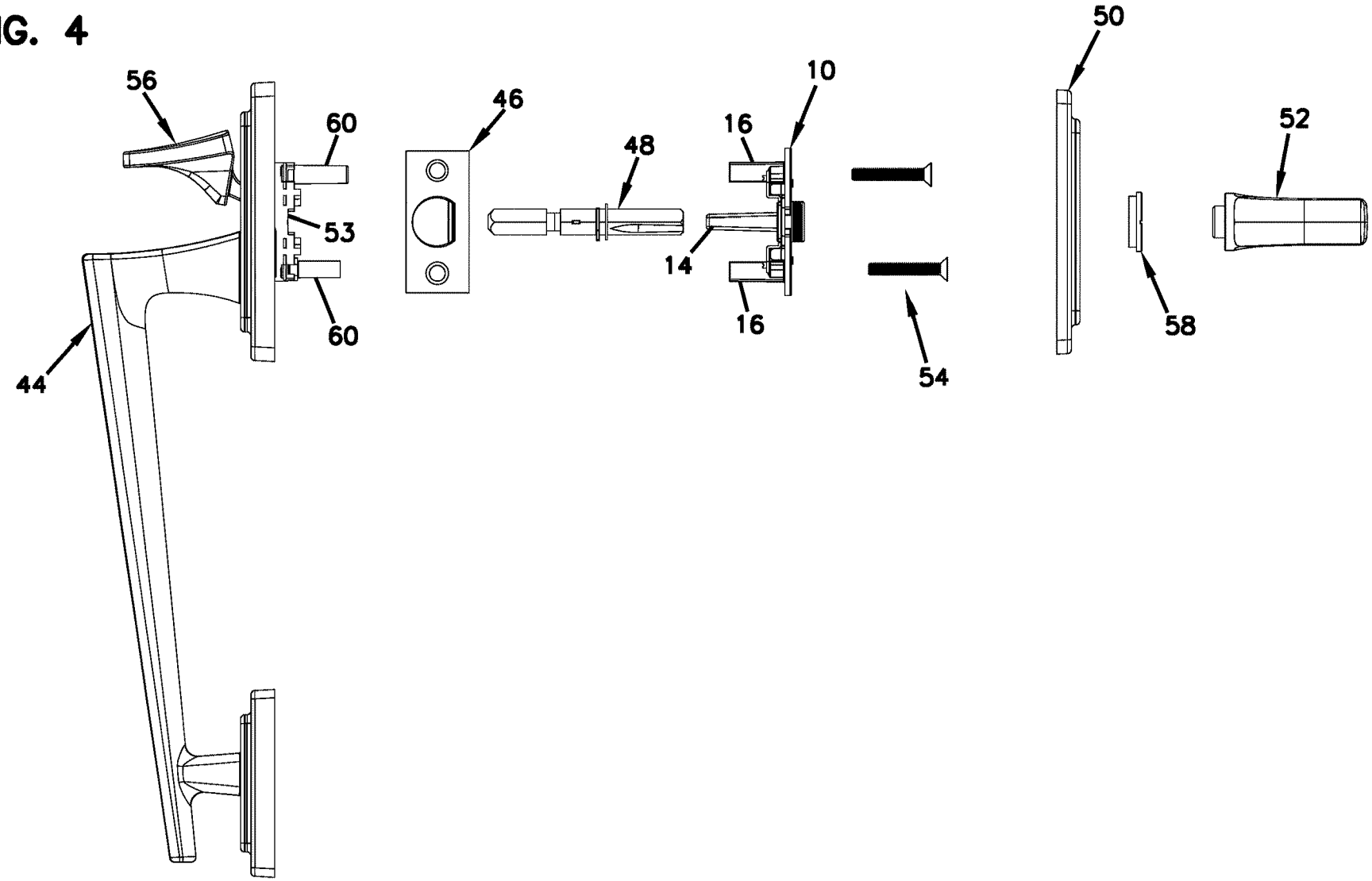
FIG. 4 shows a side view of the handle set installation of FIG. 3.

Referring to FIGS. 3 and 4, the adapter 10 described in FIGS. 1 and 2 is shown in an exploded installation of a handle set for an entry door application. An outside handle 44 is configured for mounting on an exterior side of an entry door (not pictured). A rose 57 conceals the mounting points of the outside handle 44 to the door. A switch 56 may be depressed in order to rotate the spindle 48. The switch 56 is connected to a mechanical device 53 concealed by the rose 57 in FIG. 3, but viewable in FIG. 4, that converts the linear motion generated when the switch 56 is depressed into a rotary motion. This rotary motion is transferred to a latch 46, an adapter 10, and the inside lever 52 by the spindle 48. The spindle 48 also mechanically links the inside lever 52 to the adapter 10, latch 46, and switch 56. Preferably, a multi-piece spindle 48 is used and the portion of the spindle 48 in contact with the switch operates just the latch 46 to avoid movement of the switch 56 from rotating the inside lever 52, and vice versa.

A rose 50 conceals the adapter 10 and fasteners 54 that are used to secure the adapter to the interior side of the door. The fasteners 54 pass through the receivers 16 in the adapter 10 and into posts 60 of the outside handle 44. As the fasteners 54 are tightened, the adapter 10 and outside handle 44 are drawn together thereby squeezing the door in between and securing them to the door. The latch 46 is held in place by both the spindle 48 passing through the latch 46 and the arm 14 passing through the latch 46. The spindle 48 rotates to retract the latch 46 while the arm 14 prevents the latch 46 from rotating. A rose trim screw 58 fastens to the adapter 10 and maintains the rose 50 secured to the adapter 10.

As previously discussed, the springs 20 and sleeve 38 maintain the inside lever 52 at a home position, as depicted in FIG. 4. The sleeve 38 also prevents any rotational slop in the movement of the inside lever 52. The result is a more positive and secure connection of the inside lever 52 to the spindle 48 and adapter 10.

Figure 5:
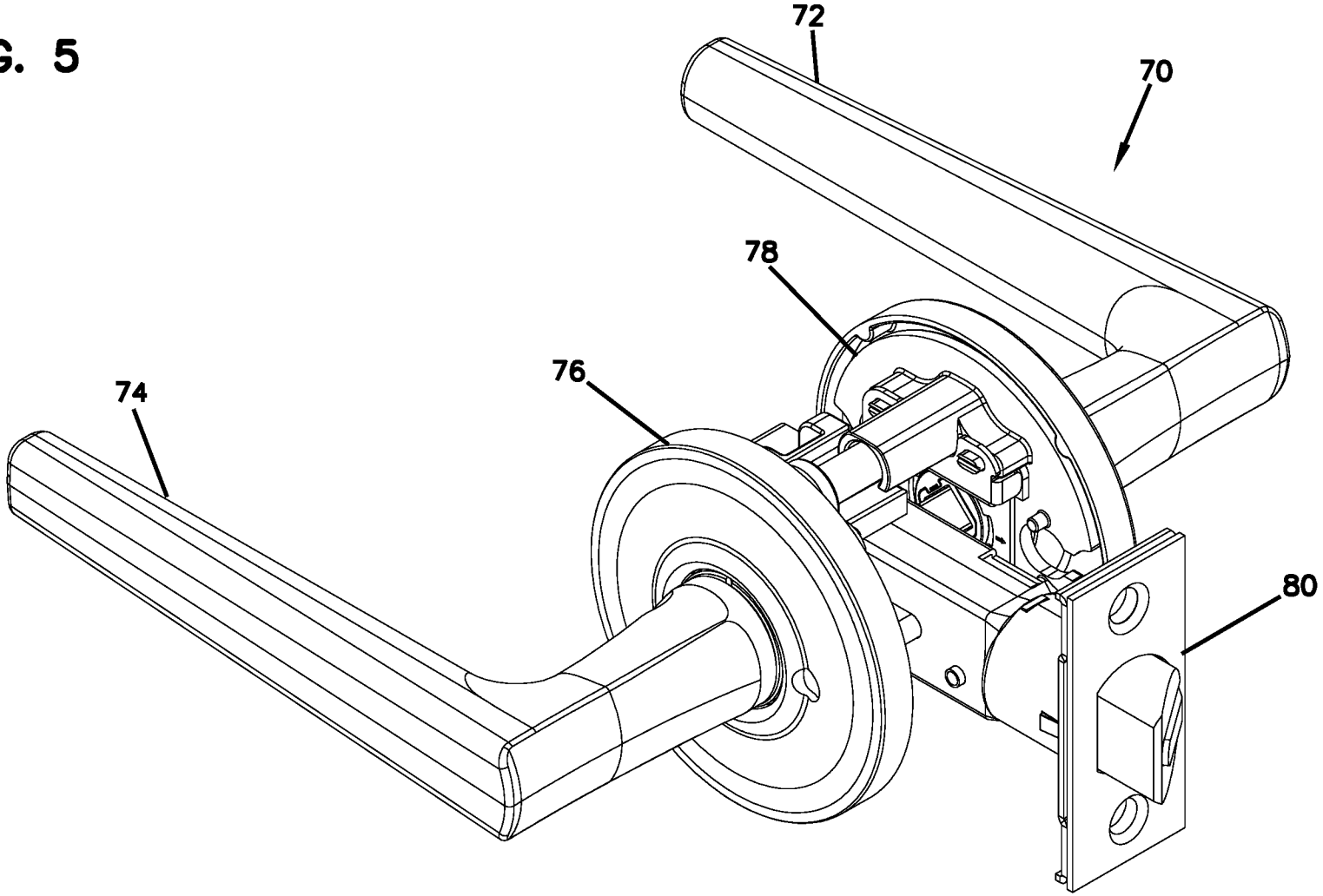
FIG. 5 shows a perspective view of a lever set installation using an adapter according to an alternative embodiment of the invention.

Another embodiment of the invention is shown in FIG. 5 as a lever set 70 incorporating the spring plate 18, slide 22, springs 20, and sleeve 38 as shown in FIG. 2. In this embodiment, an exterior lever 74 and exterior rose 76 are mounted to the exterior side of a door (not pictured). An interior lever 72 and interior rose 78 are mounted to an interior side of the door. The interior lever 72 and the exterior lever 74 may be rotated to retract latch 80 thereby allowing the door to open. As there are two levers used in this embodiment as opposed to a single lever and a handle, there are slight differences from the previously-mentioned embodiment. These differences do not affect the function of the springs 20, slide 22, spring plate 18, hub 36, and sleeve 38 as described with respect to FIGS. 1 and 2.

Figure 6:
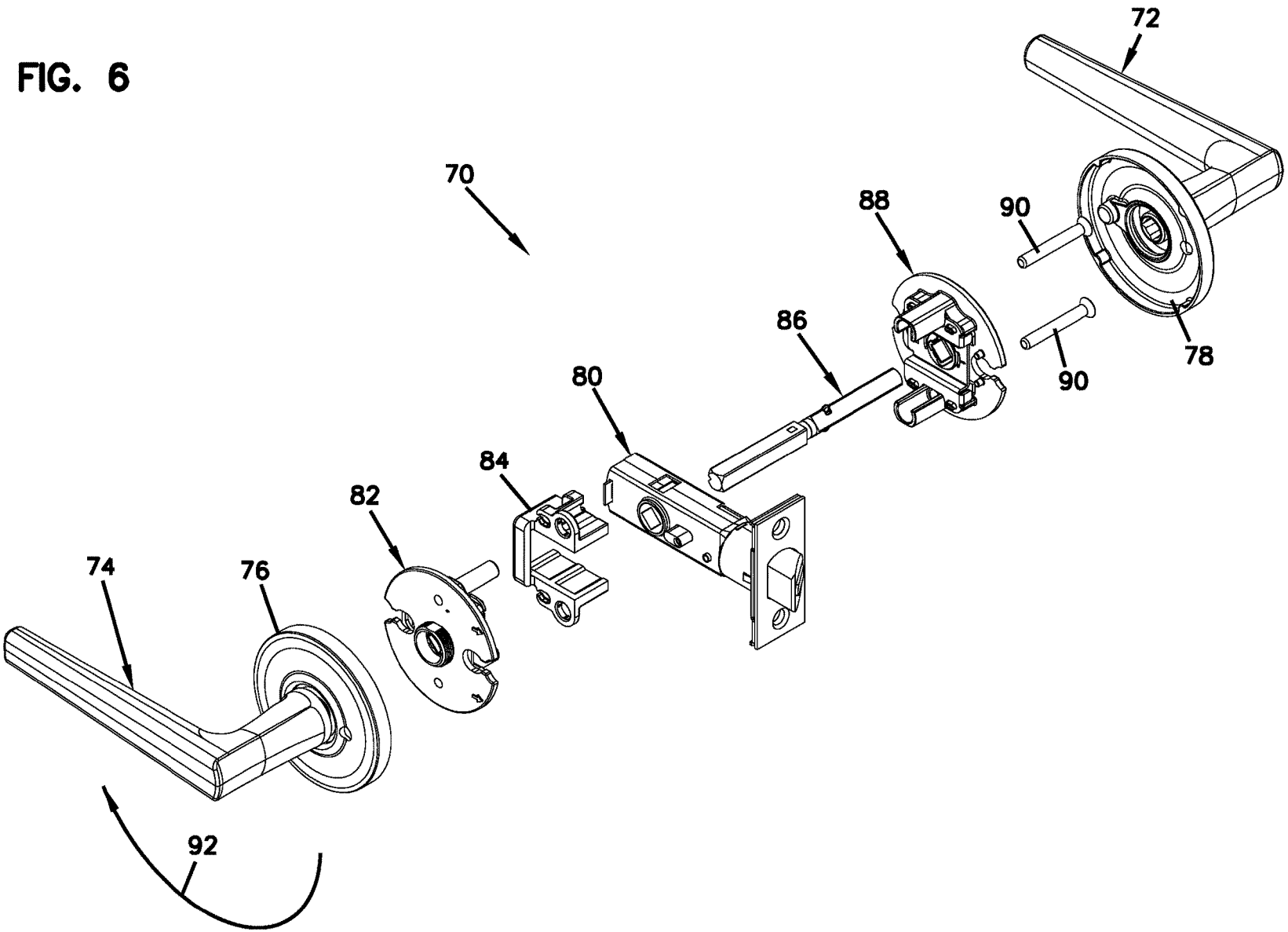
FIG. 6 shows a partially exploded perspective view of the lever set installation according to FIG. 5.

FIG. 6 shows an exploded view of the lever set 70. A first adapter 88 and a second adapter 82 are shown, one on the interior side and one on the exterior side. Each adapter 88, 82 includes the same parts and functions similarly. One of the adapters is configured to receive fasteners (female fitting) while the opposing adapter has through holes (male fitting). The exterior lever 74 is joined to the spindle 86 thereby allowing rotational force 92 to transfer to the second adapter 82, latch 80, first adapter 88, and interior lever 72. As the rotational force 92 is applied to the exterior lever 74, the second adapter 82 adds opposing tension to resist the rotational force 92. This opposing tension assists in maintaining the exterior lever 74 in a home, horizontal position. The exterior rose 76 may also be used to conceal the second adapter 82 which is secured to the surface of the door. As the first adapter 88 used in the lever set 70 application does not have an arm 14 as shown in FIGS. 1 and 2, an adapter bracket 84 is used to secure the latch 80 in place and prevent rotation as the spindle 86 is rotated by either the exterior lever 74 or the interior lever 72. Fasteners 90 pass through the first adapter 88, through the adapter bracket 84, and into the second adapter 82. The fasteners 90 sandwich the door between the second adapter 82 and the first adapter 88 while the latch 80 and adapter bracket 84 remain within a bore in the door. The interior rose 78 conceals the first adapter 88 and the exterior rose 76 conceals the second adapter 82.

Figure 7:
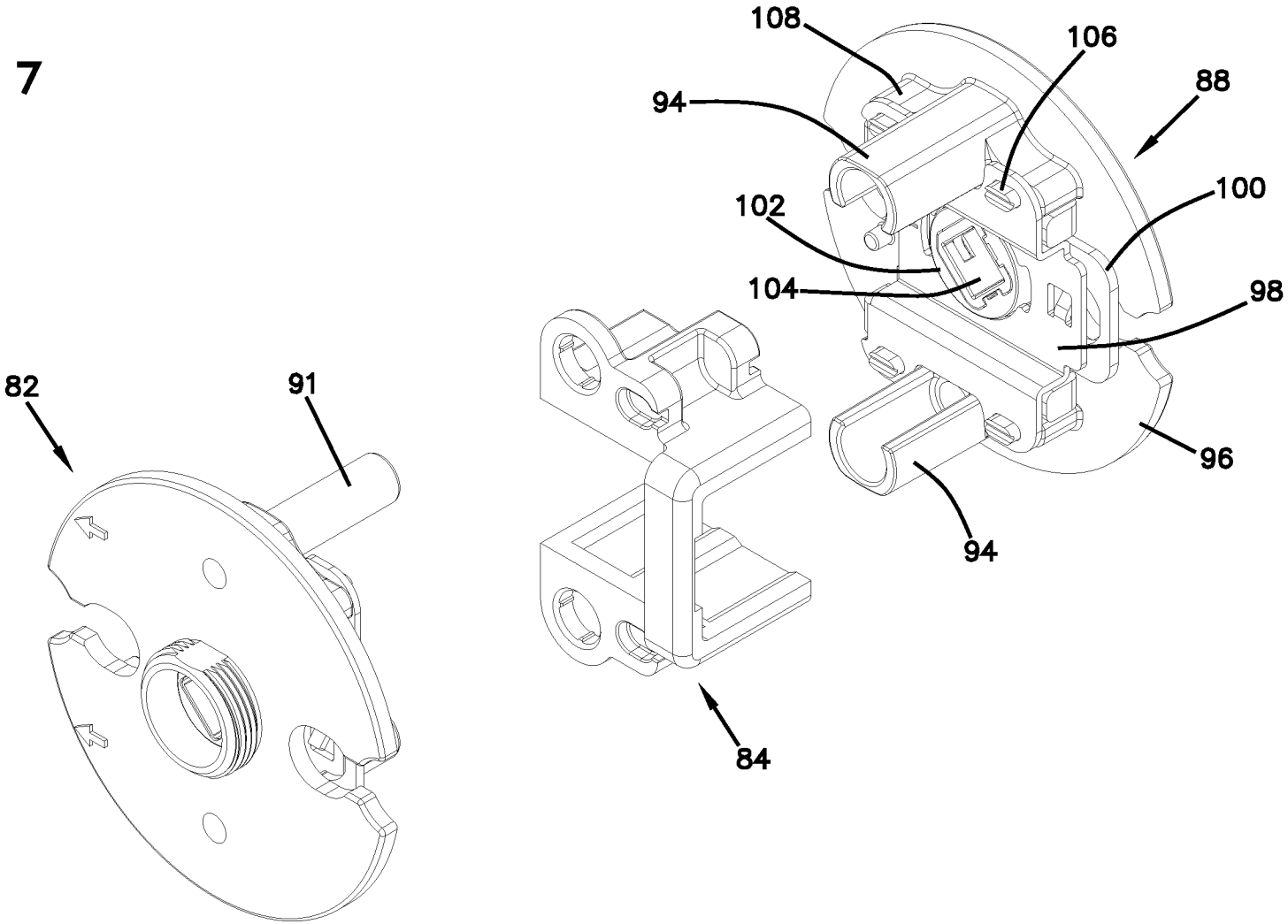
FIG. 7 shows a partially exploded perspective view of the adapter of FIG. 5.

Referring to FIG. 7, a partially exploded view of the first adapter 88, second adapter 82, and adapter bracket 84 is shown. The first adapter 88 shown in FIGS. 6 and 7 is the same as the adapter 10 shown in FIGS. 1 and 2, except that the adapter 88 does not include an arm 14. This is due to the difference in application of using a handle set shown in FIG. 3 as opposed to a lever set shown in FIG. 5. The mechanical workings of the first adapter 88 do not differ from the previously discussed mechanicals of adapter 10 shown and described with respect to FIG. 2.

The first adapter 88 shown in FIG. 7 includes the adapter bracket 84 that holds the latch 80 in position as a rotational force 92 is applied to either lever (see FIG. 6). As previously described with respect to adapter 10, the first adapter 88 includes a pair of receivers 94 that accept posts 91 from the second adapter 82. Studs 106 maintain a spring plate 98 and a slide 100 in place and secured to a base 108 of a flange 96. As rotational force 92 is applied (as shown in FIG. 6), a sleeve 104 and a hub 102 rotate thereby compressing the springs within the spring chambers of the spring plate 98 as previously described with respect to FIG. 2.

With both embodiments of the invention as described with respect to FIGS. 2 and 7, both adapters 10, 88 perform the same functions with the same components. The only difference is a lack of an arm 14 with the embodiment shown in FIG. 7. As a result, the adapters 10, 88 minimize any play in the lever through the use of a sleeve 38 shown in FIG. 2 or sleeve 104 shown in FIG. 7. The sleeve is preferably formed out of a compressible material such as plastic allowing for a greater range of manufacturing tolerances when constructing the associated spindle. The overall goal is to provide a tight, press-fit between the spindle and the sleeve. The use of springs 20, shown in FIG. 2, also minimizes any unintended sagging of the lever due to the weight of the lever itself. The springs 20 can therefore be pre-loaded to maintain the levers at the predetermined home position of horizontal when not in use, despite having a great mass due to solid forging manufacturing techniques.

In accordance with the preceding disclosure, various aspects of a door handle adapter are disclosed. In one aspect, the door handle adapter includes a spindle configured to engage the door handle and transfer an input rotational force from the door handle, as well as a hub with a central aperture configured to receive the spindle and further transfer the rotational force from the spindle. The door handle adapter includes a first engager extending from an outer circumference of the hub, and a second engager opposite the first engager extending from the outer circumference of the hub. The adapter includes a slider with a first receiver configured to engage the first engager and a second receiver configured to engage the second engager such that as the rotational force is transmitted to the hub, thereby axially rotating the hub, at least one of the first and second engagers linearly displace the slider. The adapter further includes a first spring configured to engage the first receiver when the rotational force is in a first direction and also when the rotational force is in an opposing direction, as well as a second spring to engage the second receiver when the rotational force is in the first direction and also when the rotational force is in the opposing direction. The adapter includes a spacer formed of a material softer and more compressible than the hub and spindle inserted between the spindle and hub configured to retain a positive engagement between the spindle and hub.

In further examples, the adapter described above may be modified by the hub being formed of one of zinc, brass, steel, and aluminum, and the spacer is a polymer. Stull further, such an adapter can include a liner providing a backstop for the first and second spring, wherein the first and second receiver provide opposing backstops for the respective first and second springs, thereby sandwiching at least a portion of each spring in between, respectively. The first and second receivers can be inserted in between a plurality of coils of the respective first and second springs, thereby engaging the springs when the slider is linearly displaced by the axial rotation of the spindle and hub.

Still further, in some example aspects, the slider of any of the above examples is linearly displaced in the same direction when the hub is axially rotated the first direction as when the hub is axially rotated the opposing direction. Further, the first and second springs maintain a torsional resistance against the input rotational force at all times.

In a further example, a door handle adapter includes a hub with an open inner circumference configured to receive a spindle and transfer a rotational force input into the spindle, as well as a first engager extending from an outer circumference of the hub. The door handle adapter further includes a second engager extending from the outer circumference of the hub, as well as a slider with a first receiver configured to engage the first engager and a second receiver configured to engage the second engager such that, as the rotational force is transferred to the hub, the hub axially rotates, thereby urging a linear displacement of the slider through contact between one of the first engager with the first receiver and the second engager with the second receiver. The door handle adapter includes a first spring configured to engage the first receiver when the rotational force is in a first direction, and a second spring configured to engage the second receiver when the rotational force is in a second direction opposing the first direction. The door handle adapter includes a spacer, formed of a material softer and more compressible than the hub and the spindle, press-fitted between the spindle and hub configured to retain a positive engagement between the spindle and hub.

In further aspects, the hub of the above door handle adapter is formed of one of zinc, brass, steel, and aluminum, and the spacer is a polymer. The door handle adapter above can further include a liner providing a backstop for the first and second spring, wherein the first and second receivers provide opposing backstops for the respective first and second springs, thereby sandwiching at least a portion of each spring in between the respective backstop and receiver. In some aspects, the first and second receivers are inserted in between a plurality of coils of the respective first and second springs, thereby engaging the springs when the slider is moved. In further aspects, the slider is linearly displaced in the same direction irrespective of a direction of the rotational force of the hub. In some aspects, the first and second springs maintain a torsional resistance against the input rotational force at all times.

In a still further example, a door handle adapter includes a hub with an open inner circumference configured to receive a spindle and transfer a rotational force input into the spindle, as well as a first engager extending from an outer circumference of the hub. The door handle adapter further includes a slider with a first receiver configured to engage the first engager such that as the rotational force is transferred to the hub, the hub axially rotates thereby urging a linear displacement of the slider through contact between the first engager with the first receiver. The door handle adapter further includes a first spring configured to engage the first receiver when the rotational force is in a first direction. The door handle adapter also includes a spacer, formed of a material softer and more compressible than the hub and the spindle, press-fitted between the spindle and hub configured to retain a positive engagement between the spindle and hub.

In further examples, the hub is formed of one of zinc, brass, steel, and aluminum, and the spacer is a polymer. The door handle adapter can also include a liner providing a backstop for the first spring, as well as a backstop for the first spring formed from a portion of the liner, thereby sandwiching a portion of the first spring in between the backstop and receiver. In such examples, the first receiver is inserted in between a plurality of coils of the first spring, thereby engaging the spring when the slider is moved.

In further example aspects, the slider is linearly displaced in the same direction irrespective of a direction of the rotational force of the hub. Additionally, the first spring maintains a torsional resistance against the input rotational force at all times. The door handle adapter can further include a second engager extending from the outer circumference of the hub, a second receiver connected to the first receiver configured to engage the second engager, and a second spring configured to engage the second receiver when the rotational force is in the first direction and also when the rotational force is in a second direction opposing the first direction. In such examples, the first receiver and second receiver are joined together proximate the hub.

Although the present disclosure has been described with reference to particular means, materials, and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

We claim:

1. A door handle adapter assembly installable on a door and positionable adjacent a latch, the door handle adapter assembly comprising:

a spindle configured to engage a door handle and transfer an input rotational force from the door handle to the latch;

a door handle adapter including:

a flange configured to position the door handle adapter against an exterior surface of the door;

a hub with a central aperture configured to receive the spindle and further transfer the input rotational force from the spindle;

a first engager extending from an outer circumference of the hub;

a second engager opposite the first engager extending from the outer circumference of the hub;

a plate connected to the flange and having a plate opening;

a slider positioned between the plate and the flange, the slider having a slider opening enclosed, a side of the slider opening defining a first receiver and a second receiver, the first receiver configured to engage the first engager and the second receiver configured to engage the second engager such that as the input rotational force is transmitted to the hub, thereby axially rotating the hub, at least one of the first engager and the second engager linearly displace the slider;

the slider having a first spring stop and a second spring stop, wherein the slider and the plate cooperatively form opposing sides and an end of each of a first spring chamber and a second spring chamber, a first spring positioned within the first spring chamber between the slider and the plate with a first spring end against the first spring stop of the slider and configured to compress when the input rotational force is in a first direction and also when the input rotational force is in an opposing direction;

a second spring positioned within the second spring chamber between the slider and the plate with a second spring end against the second spring stop of the slider and configured to compress when the input rotational force is in the first direction and also when the input rotational force is in the opposing direction; and a spacer being formed of a material softer and more compressible than the hub and the spindle, the spacer being positioned between the spindle and the hub;

wherein the first spring chamber and the second spring chamber are oriented to hold the first spring in parallel with the second spring and the plate opening is located between the first spring chamber and the second spring chamber;

wherein when the first spring is in an extended position, the first spring stop is on an opposite side of the plate opening from an end of the first spring chamber defined by the plate; and wherein the spindle extends through the plate opening.

2. The door handle adapter assembly according to claim 1, wherein the hub is formed of one of zinc, brass, steel, and aluminum, and the spacer is a polymer.

3. The door handle adapter assembly according to claim 1, wherein the slider is linearly displaced in the same direction when the hub is axially rotated the first direction as when the hub is axially rotated the opposing direction.

4. The door handle adapter assembly according to claim 1, wherein the first spring and the second spring maintain a torsional resistance against the input rotational force at all times.

5. The door handle adapter assembly according to claim 1, wherein at least part of the plate opening and at least part of the slider opening are aligned with the central aperture of the hub to allow the spindle to pass through.

6. A door handle adapter comprising:

a flange configured to position the door handle adapter against an exterior surface of a door;

a hub with an open inner circumference configured to receive a spindle and transfer an input rotational force into the spindle;

a first engager extending from an outer circumference of the hub;

a second engager extending from the outer circumference of the hub;

a plate connected to the flange and having a plate opening;

a slider positioned between the plate and the flange, the slider having a slider opening enclosed, a side of the slider opening defining a first receiver and a second receiver, the first receiver configured to engage the first engager and the second receiver configured to engage the second engager such that as the input rotational force is transferred to the hub, the hub axially rotates thereby urging a linear displacement of the slider through contact between one of the first engager with the first receiver and the second engager with the second receiver;

the slider having a first spring stop and a second spring stop, wherein the slider and the plate cooperatively form opposing sides and an end of each of a first spring chamber and a second spring chamber;

a first spring positioned within the first spring chamber between the slider and the plate with a first spring end against the first spring stop of the slider and configured to compress when the input rotational force is in a first direction;

a second spring positioned within the second spring chamber between the slider and the plate with a second spring end against the second spring stop of the slider and configured to compress when the input rotational force is in a second direction opposing the first direction; and a spacer being formed of a material softer and more compressible than the hub and the spindle, the spacer configured to be press-fitted between the spindle and the hub;

wherein the first spring chamber and the second spring chamber are oriented to hold the first spring in parallel with the second spring and the plate opening is located between the first spring chamber and the second spring chamber;

wherein when the first spring is in an extended position, the first spring stop is on an opposite side of the plate opening from an end of the first spring chamber defined by the plate; and wherein the spindle extends through the plate opening.

7. The door handle adapter according to claim 6, wherein the hub is formed of one of zinc, brass, steel, and aluminum, and the spacer is a polymer.

8. The door handle adapter according to claim 6, wherein the slider is linearly displaced in the same direction irrespective of a direction of the input rotational force of the hub.

9. The door handle adapter according to claim 6, wherein the first spring and the second spring maintain a torsional resistance against the input rotational force at all times.

10. A door handle adapter comprising:

a flange configured to position the door handle adapter against an exterior surface of a door;

a hub with an open inner circumference configured to receive a spindle and transfer an input rotational force into the spindle;

a first engager extending from an outer circumference of the hub;

a plate connected to the flange and having a plate opening;

a slider positioned between the plate and flange, the slider having a slider opening enclosed, a side of the slider opening defining a first receiver, the first receiver configured to engage the first engager such that as the input rotational force is transferred to the hub, the hub axially rotates thereby urging a linear displacement of the slider inwardly toward the spindle through contact between the first engager with the first receiver;

the slider having a first spring stop, wherein the slider and the plate cooperatively form a first spring chamber;

a first spring positioned within the first spring chamber between the slider and the plate with an end against the first spring stop of the slider and configured to compress when the input rotational force is in a first direction; and a spacer being formed of a material softer and more compressible than the hub and the spindle, the spacer configured to be press-fitted between the spindle and the hub;

wherein the first spring chamber and a second spring chamber are oriented to hold the first spring in parallel with a second spring and the plate opening is located between the first spring chamber and the second spring chamber;

wherein when the first spring is in an extended position, the first spring stop is on an opposite side of the plate opening from an end of the first spring chamber defined by the plate; and wherein the spindle extends through the plate opening.

11. The door handle adapter according to claim 10, wherein the hub is formed of one of zinc, brass, steel, and aluminum, and the spacer is a polymer.

12. The door handle adapter according to claim 10, wherein the slider is linearly displaced in the same direction irrespective of a direction of the input rotational force of the hub.

13. The door handle adapter according to claim 10, wherein the first spring maintains a torsional resistance against the input rotational force at all times.

* * * * *